US007499671B2

(12) United States Patent
Kozaki et al.

(10) Patent No.: US 7,499,671 B2
(45) Date of Patent: Mar. 3, 2009

(54) RECEIVER APPARATUS AND SATELLITE BROADCAST RECEPTION SYSTEM THEREWITH

(75) Inventors: Masato Kozaki, Suita (JP); Jiro Miyahara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 583 days.

(21) Appl. No.: 11/220,616

(22) Filed: Sep. 8, 2005

(65) Prior Publication Data

US 2006/0052053 A1 Mar. 9, 2006

(30) Foreign Application Priority Data

Sep. 9, 2004 (JP) ..... 2004-262032

(51) Int. Cl.
*H04H 1/00* (2006.01)

(52) U.S. Cl. ..... 455/3.02; 455/430; 455/13.4; 455/343.1

(58) Field of Classification Search ..... 455/3.01–3.05, 455/427, 430, 133, 572, 574, 343.2–5, 57, 455/343.1–6, 12.1, 13.4, 69, 522; 345/211
See application file for complete search history.

(56) References Cited

U.S. PATENT DOCUMENTS 5,345,591 A * 9/1994 Tsurumaki et al. ..... 725/69
6,728,513 B1 * 4/2004 Nishina ..... 455/3.02
7,207,054 B1 * 4/2007 Richards et al. ..... 725/72

FOREIGN PATENT DOCUMENTS

JP 2001-127661 A 5/2001
JP 2002-218329 A 8/2002
JP 2005-102016 A 4/2005

* cited by examiner

*Primary Examiner*—John J Lee
(74) *Attorney, Agent, or Firm*—Birch, Stewart, Kolasch & Birch, LLP

(57) ABSTRACT

In an LNB 10, a power supply circuit 12 has pre-regulators PRa and PRb provided one for each of power supply paths respectively from ports 13*a* and 13*b*, a bypass portion BP that, when the potential difference between the output terminals of the pre-regulators PRa and PRb is greater than a predetermined threshold value, short-circuits together those output terminals, and main regulators REG1 and REG2 provided in the stage following the bypass portion BP to generate, from the output voltages Va' and Vb' of the pre-regulators PRa and PRb, drive voltages VA and VB for the internal circuits A and B. With this circuit configuration, simple though it is, even if there are instantaneous variations in the voltages fed from a plurality of receivers connected, no variations appear in the currents respectively extracted therefrom.

11 Claims, 4 Drawing Sheets

RECEIVER APPARATUS AND SATELLITE BROADCAST RECEPTION SYSTEM THEREWITH

This nonprovisional application claims priority under 35 U.S.C. § 119(a) on Patent Application No. 2004-262032 filed in Japan on Sep. 9, 2004, the entire contents of which are hereby incorporated by reference.

BACKGROUND OF THE INVENTION

1. Field of the Invention

The present invention relates to a receiver apparatus to which a plurality of receivers can be connected. More particularly, the present invention relates to an LNB (low noise block down converter) with which a satellite broadcast reception system is built.

2. Description of Related Art

FIG. 3 is a block diagram showing an example of a conventional LNB. The LNB 100 shown in this figure includes: a reception circuit 101 that extracts a plurality of channel signals from a satellite signal received via an unillustrated reflector, that then amplifies the extracted signals on a low-noise basis, and that then selects from the amplified signals those requested by receivers 200*a* and 200*b* to feed the selected signals thereto; a power supply circuit 102 that generates a supply voltage from which the LNB 100 operates; and ports 103*a* and 103*b* to which the receivers 200*a* and 200*b* are respectively connected. The power supply circuit 102 includes: diodes Da and Db of which the anodes are respectively connected to the ports 103*a* and 103*b* and of which the cathodes are connected together; and regulators REG1 and REG2 whose input terminals are together connected to the cathodes of the diodes Da and Db.

In the LNB 100 configured as described above, the power supply circuit 102 receives, via the ports 103*a* and 103*b*, direct-current voltages Va and Vb from the receivers 200*a* and 200*b*. The regulators REG 1 and REG2 respectively generate predetermined direct-current voltages VA and VB (for example, 5 [V] and 6 [V]) from the direct-current voltages Va and Vb, and then feed the generated voltages to the relevant parts of the LNB 100.

The direct-current voltages Va and Vb are used not only as the input voltages to the regulators REG1 and REG2, but also as output select signals for the reception circuit 101, each of those signals being shifted among a plurality of voltage levels (for example, between two levels of 13 [V] and 18 [V]) according to the frequency band of the desired channel signal. If the direct-current voltage Va is higher than the direct-current voltage Vb, the diode Da alone is on, and thus the direct-current voltage Va is fed to the regulators REG1 and REG2 as the input voltage thereto; if the direct-current voltage Vb is higher than the direct-current voltage Va, the diode Db alone is on, and thus the direct-current voltage Vb is fed to the regulators REG1 and REG2 as the input voltage thereto.

With the LNB 100 configured as described above, when reception channels are switched, even if there is a difference between the direct-current voltages Va and Vb respectively fed to the ports 103*a* and 103*b*, the rectifying action of the diodes Da and Db prevents backflow current from the higher-potential port to the lower-potential port, and thus prevents a receiver breakdown.

However, with the LNB 100 configured as described above, in which the currents Ia and Ib fed from the receivers 200*a* and 200*b*, of which a plurality is connected to the LNB 100, are simply added together through diodes for consumption, when there is a difference between the direct-current voltages Va and Vb, all the current consumed by the LNB 100 is extracted solely from the receiver that feeds it with the higher voltage, with no current whatsoever extracted from the other receiver. As a result, with the LNB 100 configured as described above, when reception channels are switched, every time the magnitudes of the direct-current voltages Va and Vb are reversed, the currents Ia and Ib vary greatly, producing noise, and thus resulting in malfunctioning of the LNB 100 and disturbances in received images.

To overcome this problem, in one conventionally disclosed/proposed receiver apparatus, when a plurality of receivers are connected thereto, it extracts current preferentially from the receiver connected to a predetermined port irrespective of the magnitudes of the direct-current voltages fed from the individual receivers (see Japanese Patent Application Laid-Open No. 2002-218329, hereinafter Patent Publication 1). In another conventionally disclosed/proposed receiver apparatus, the total current it consumes is equally distributed among different ports so that equal currents are extracted from a plurality of receivers connected thereto (see Japanese Patent Application Laid-Open No. 2001-127661, hereinafter Patent Publication 2).

Indeed, with the receiver apparatuses disclosed in Patent Publications 1 and 2 mentioned above, when reception channels are switched, even if the magnitudes of the direct-current voltages fed from the a plurality of receivers connected thereto vary, the currents extracted from the individual receivers do not vary. Thus, no noise is produced that results from variations in those currents and that leads to malfunctioning of the receiver apparatus or disturbances in received images.

However, with the receiver apparatus disclosed Patent Publication 1, the current feeding capacity of the receiver connected to a port other than the predetermined one cannot be exploited at all. Thus, when a receiver with a low current feeding capacity is connected to the predetermined port, even if a receiver with a higher current feeding capacity is connected to another port, the receiver apparatus may fail to operate normally because of an insufficient supply of current.

On the other hand, with the receiver apparatus disclosed in Patent Publication 2 (see FIG. 4), the total current it consumes cannot always be distributed equally between the ports 103*a* and 103*b* due to variations in the characteristics of the components constituting the distribution circuit DIV (hereinafter referred to as component-to-component variations), producing differences between the values of the currents extracted from the receivers 200*a* and 200*b*. Furthermore, the distribution performance of the distribution circuit DIV depends not only on the above-mentioned component-to-component variations but also on variations in the voltages it receives. Thus, even if regulators are provided one for each port in the stage preceding the distribution circuit DIV, slight variations in the voltages the regulators output also produce differences in the values of the currents extracted from the receivers 200*a* and 200*b*. Moreover, employing the distribution circuit DIV, the receiver apparatus has a complicated circuit configuration, demanding higher cost and requiring an increased mounting footprint.

In still another conventionally proposed configuration that does not suffer from variations in the currents extracted from a plurality of receivers connected thereto even if the voltages fed from the individual receivers vary, transistor switches and a microcomputer are used to meticulously control how the total current consumed is extracted from each of the plurality of receivers (see Japanese Patent Application Laid-Open No. 2005-102016, Patent Publication 3). With this configuration, however, it takes some time for the transistor switches to perform on/off switching and for the microcomputer to perform signal processing. This makes it difficult to readily follow an instantaneous voltage change (e.g., one resulting form the turning on/off of a receiver). This may cause a failure (e.g., a momentary voltage drop) in the receiver apparatus.

SUMMARY OF THE INVENTION

In view of the conventionally experienced inconveniences described above, it is an object of the present invention to provide a receiver apparatus that has a simple circuit configuration but nevertheless does not suffer from variations in the currents extracted from a plurality of receivers connected thereto even if the voltages fed from the individual receivers vary instantaneously.

To achieve the above object, according to the present invention, a receiver apparatus is provided with a plurality of external terminals to which receivers are individually disconnectably connected, a plurality of internal circuits having mutually different power source paths, and a power supply circuit that receives electric power from the receivers and generates drive voltages for the internal circuits. The power supply circuit includes pre-regulators provided one for each of power supply paths respectively from the external terminals, a bypass portion that, when the potential difference between the output terminals of the pre-regulators is greater than a predetermined threshold value, short-circuits together the output terminals, and main regulators provided in the stage following the bypass portion so as to generate, from the output voltages of the pre-regulators, the drive voltages for the internal circuits. With this circuit configuration, simply though it is, even if there are instantaneous variations in the voltages fed from the plurality of receivers connected, no variations appear in the currents respectively extracted therefrom. This makes it possible to prevent malfunctioning of the apparatus and disturbances in received images.

DETAILED DESCRIPTION OF PREFERRED EMBODIMENTS

Figure 1:
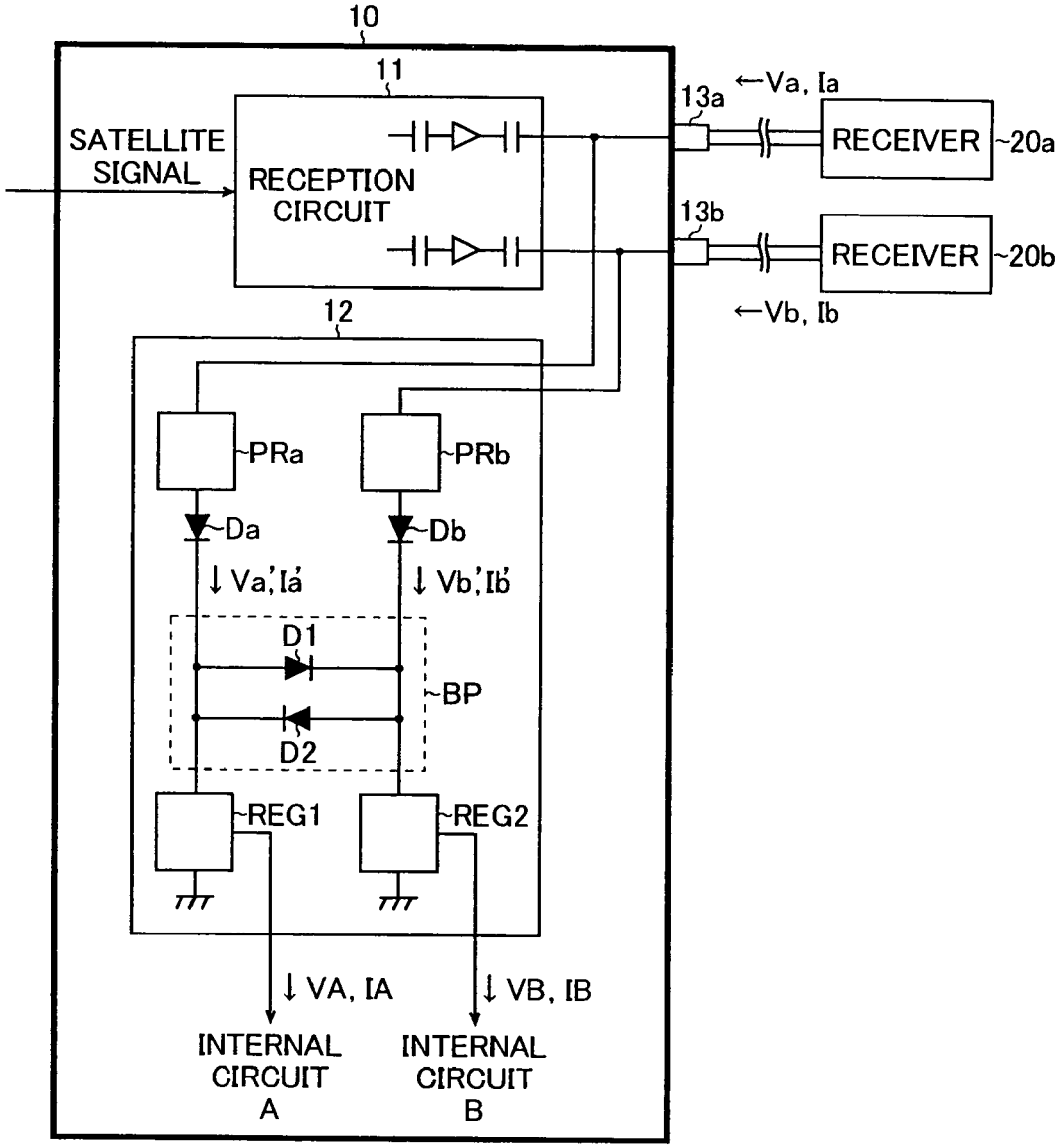
FIG. 1 is a block diagram showing the LNB of a first embodiment of the invention.

FIG. 1 is a block diagram showing the LNB of a first embodiment of the invention. As shown in this figure, the LNB 10 of this embodiment includes: a reception circuit 11 that extracts a plurality of channel signals from the satellite signals received via an unillustrated reflector, that then amplifies the extracted signals on a low-noise basis, and that then selects from the amplified signals those requested by receivers 20*a* and 20*b* to feed the selected signals thereto; a power supply circuit 12 that generates the supply voltage from which the LNB 10 operates; and ports 13*a* and 13*b* to which the receivers 20*a* and 20*b* are respectively connected.

In the LNB 10 configured as described above, the power supply circuit 12 receives, via the ports 13*a* and 13*b*, direct-current voltages Va and Vb from the receivers 20*a* and 20*b*. The power supply circuit 12 generates predetermined direct-current voltages VA and VB (for example, 5 [V] and 6 [V]) from the direct-current voltages Va and Vb, respectively, and feeds those voltages to internal circuits A and B that have mutually different power source paths. The internal circuits A and B are different sections of the LNB 10 into which the circuit elements constituting the LNB 10 are grouped according to their power consumption and their relationship with the receivers. Thus, the internal circuits A and B include, for example, an LNA (low-noise amplifier), a local oscillator, a mixer, a selector, etc. that constitute the reception circuit 11.

The direct-current voltages Va and Vb fed from the receivers 20*a* and 20*b* are used not only as the input voltages to the power supply circuit 12 but also as output select signals for the reception circuit 11, each of those signals being shifted among a plurality of voltage levels (for example, between two levels of 13 [V] and 18 [V]) according to the frequency band of the desired channel signal.

Here, in this embodiment, the power supply circuit 12 includes: pre-regulators PRa and PRb provided one for each of power supply paths respectively from the ports 13*a* and 13*b*; backflow prevention diodes Da and Db of which the anodes are respectively connected to the output terminals of the pre-regulators PRa and PRb; a bypass portion BP that, when the potential difference between the cathodes of the backflow prevention diodes Da and Db (i.e., between the output terminals of the pre-regulators PRa and PRb) is greater than a predetermined threshold value, short-circuits together those output terminals; and main regulators REG1 and REG2 provided in the stage following the bypass portion BP so as to generate the drive voltages VA and VB for the internal circuits A and B from the output voltages Va' and Vb' of the pre-regulators PRa and PRb.

Note that the pre-regulators PRa and PRb are so designed that their output voltages Va' and Vb' are equal (for example, 9 [V]).

The bypass portion BP is composed of a pair of bypass diodes D1 and D2 connected in parallel but in mutually opposite directions between the cathodes of the backflow prevention diodes Da and Db. More specifically, the anode of the bypass diode D1 and the cathode of the bypass diode D2 are together connected to the cathode of the backflow prevention diode Da, and the cathode of the bypass diode D1 and the anode of the bypass diode D2 are together connected to the cathode of the backflow prevention diode Db.

In the LNB 10 configured as described above, when both the receivers 20*a* and 20*b* are respectively connected to the ports 13*a* and 13*b*, the pre-regulators PRa and PRb generate the output voltages Va' and Vb', respectively, which are equal. As a result, unless there are excessive variations in the output voltages Va' and Vb', the voltages across the bypass diodes D1 and D2 are both lower than the forward voltage thereof (approximately 0.7 [V] in silicon diodes). This keeps the bypass portion BP in a non-short-circuiting state (a state in which no current flows through the bypass diodes D1 and D2), and thus establishes separate power source paths one from the port 13*a* to the main regulator REG1 and another from the port 13*b* to the main regulator REG2. Accordingly, the current IA consumed by the internal circuit A and the current IB consumed by the internal circuit B are extracted separately from the receivers 20*a* and 20*b*, respectively, connected to the ports 13*a* and 13*b*.

On the other hand, when the receiver 20*a* alone is connected to the port 13*a*, the pre-regulator PRa alone generates the output voltage Va'. As a result, the voltage across the bypass diode D1 is higher than the forward voltage thereof. This keeps the bypass portion BP in a short-circuiting state (a state in which a current flows through the bypass diode D1), and thus establishes separate power source paths one from the port 13*a* to the main regulator REG1 and in addition another from the port 13*a* to the main regulator REG2 via the bypass portion BP. Accordingly, the current IA consumed by the internal circuit A and the current IB consumed by the internal circuit B are both extracted from the receiver 20*a* connected to the port 13*a*.

Likewise, when the receiver 20*b* alone is connected to the port 13*b*, the pre-regulator PRb alone generates the output voltage Vb'. As a result, the voltage across the bypass diode D2 is higher than the forward voltage thereof. This keeps the bypass portion BP in a short-circuiting state (a state in which a current flows through the bypass diode D2), and thus establishes separate power source paths one from the port 13*b* to the main regulator REG2 and in addition another from the port 13*b* to the main regulator REG1 via the bypass portion BP. Accordingly, the current IA consumed by the internal circuit A and the current IB consumed by the internal circuit B are both extracted from the receiver 20*b* connected to the port 13*b*.

In this way, the pre-regulators PRa and PRb are provided one for each of the power supply paths respectively from the ports 13*a* and 13*b*, and, when the potential difference between the output terminals of the pre-regulators PRa and PRb is greater than a predetermined threshold value (in this embodiment, the forward voltage of the bypass diode D1 and D2), the bypass portion BP short-circuits those output terminals, and the main regulators REG1 and REG2 provided in the stage following the bypass portion BP generate, from the output voltages Va' and Vb' of the pre-regulators PRa and PRb, the drive voltages VA and VB for the internal circuits A and B. With this configuration, simple though it is, even if there are instantaneous variations in the voltages Va and Vb fed from the receivers 20*a* and 20*b*, no variations appear in the currents Ia and Ib respectively extracted therefrom. Thus, no noise is produced that results from variations in those currents and that leads to malfunctioning of the LNB 10 or disturbances of the received images.

The LNB 10 of this embodiment is so configured as to distribute the currents Ia and 1*b* consumed by the internal circuits A and B according exclusively to whether the bypass portion BP is in a short-circuiting or non-short-circuiting state. Thus, when both the receivers 20*a* and 20*b* are respectively connected to the ports 13*a* and 13*b*, even if there are slight variations in the output voltages Va' and Vb' of the pre-regulators PRa and PRb, no difference arises between the currents extracted from the individual receivers 20*a* and 20*b*. This allows the LNB 10 to continue to consume a constant amount of current from the receivers 20*a* and 20*b*. That is, with the LNB 10 of this embodiment, it is possible to previously calculate the amount of current consumed from the receivers 20*a* and 20*b* irrespective of input voltage variations or component-to-component variations.

Moreover, as described earlier, in this embodiment, the bypass portion BP is composed of a pair of bypass diodes D1 and D2 connected in parallel but in mutually opposite directions between the output terminals of the pre-regulators PR1 and PR2. With this configuration, it is possible to realize the bypass portion BP with an extremely simple configuration, and it is also possible to readily follow an instantaneous voltage change resulting from the turning on/off of the receivers 20*a* and 20*b* or the switching of reception channels.

The first embodiment described above deals with an example where the bypass portion BP is so configured that bypass diodes D1 and D2 are provided one for each of bypass paths and are connected in parallel but in mutually opposite directions. It should be understood, however, that the present invention may be implemented with any other configuration. For example, instead of a pair of bypass diodes, a pair of diode arrays, each composed of a plurality of bypass diodes connected in series, may be connected in parallel.

Figure 2:
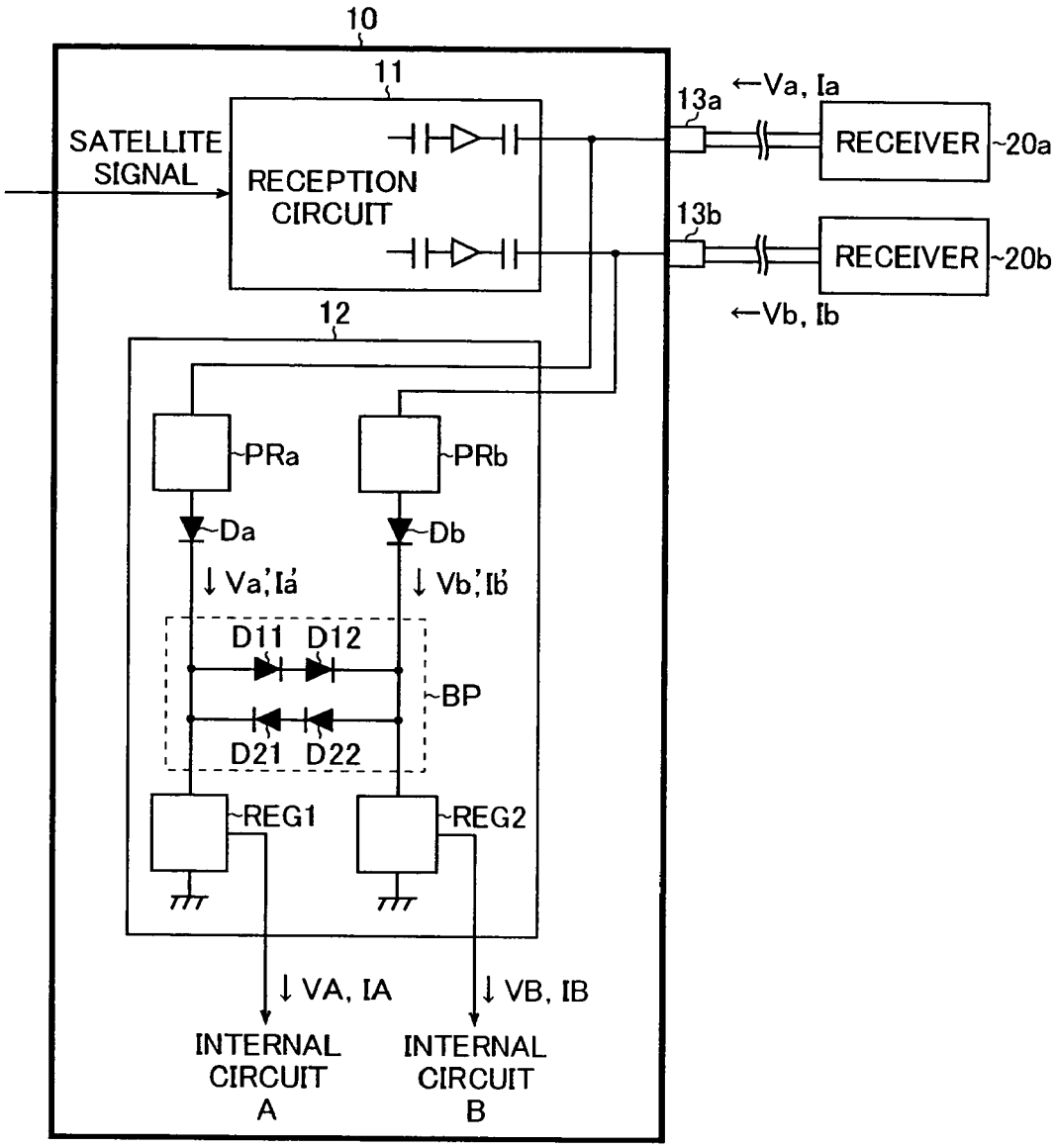
FIG. 2 is a block diagram showing the LNB of a second embodiment of the invention.
Figure 3:
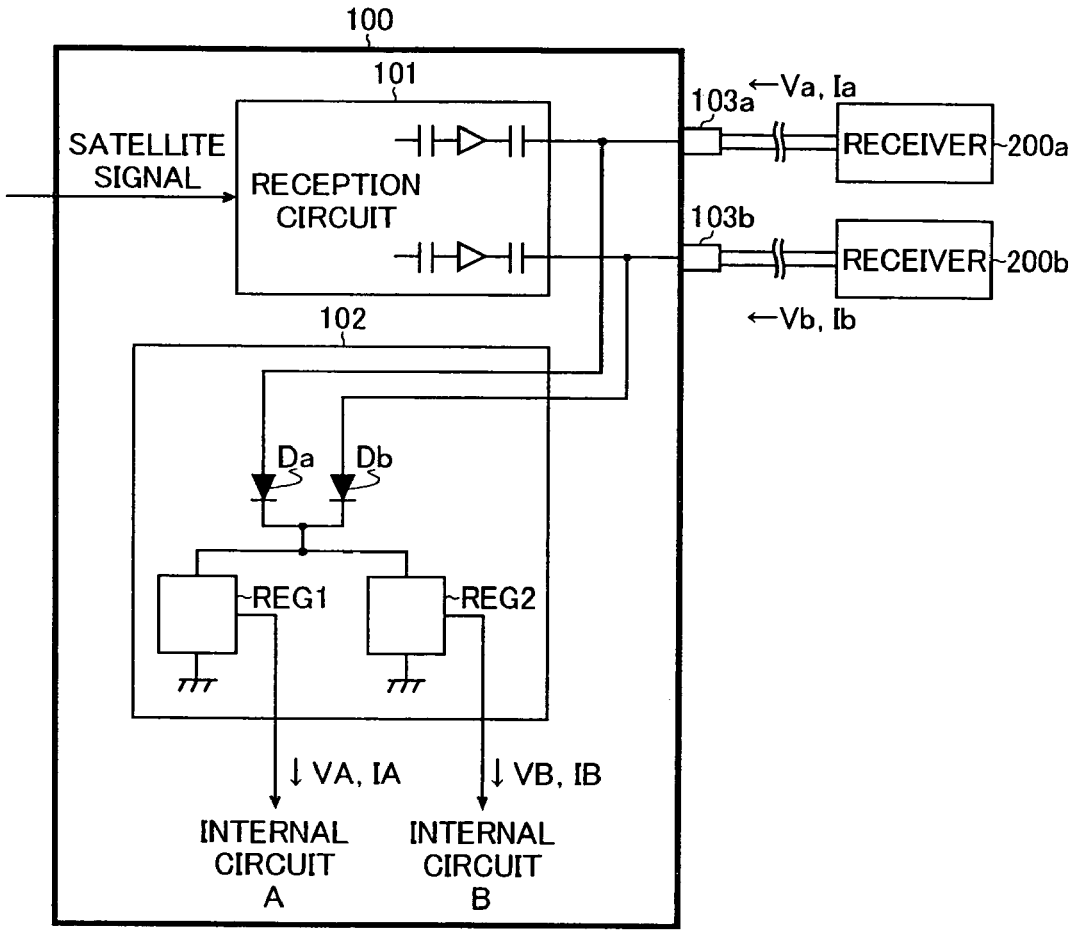
FIG. 3 Prior art
FIG. 3 is a block diagram showing an example of a conventional LNB.
Figure 4:
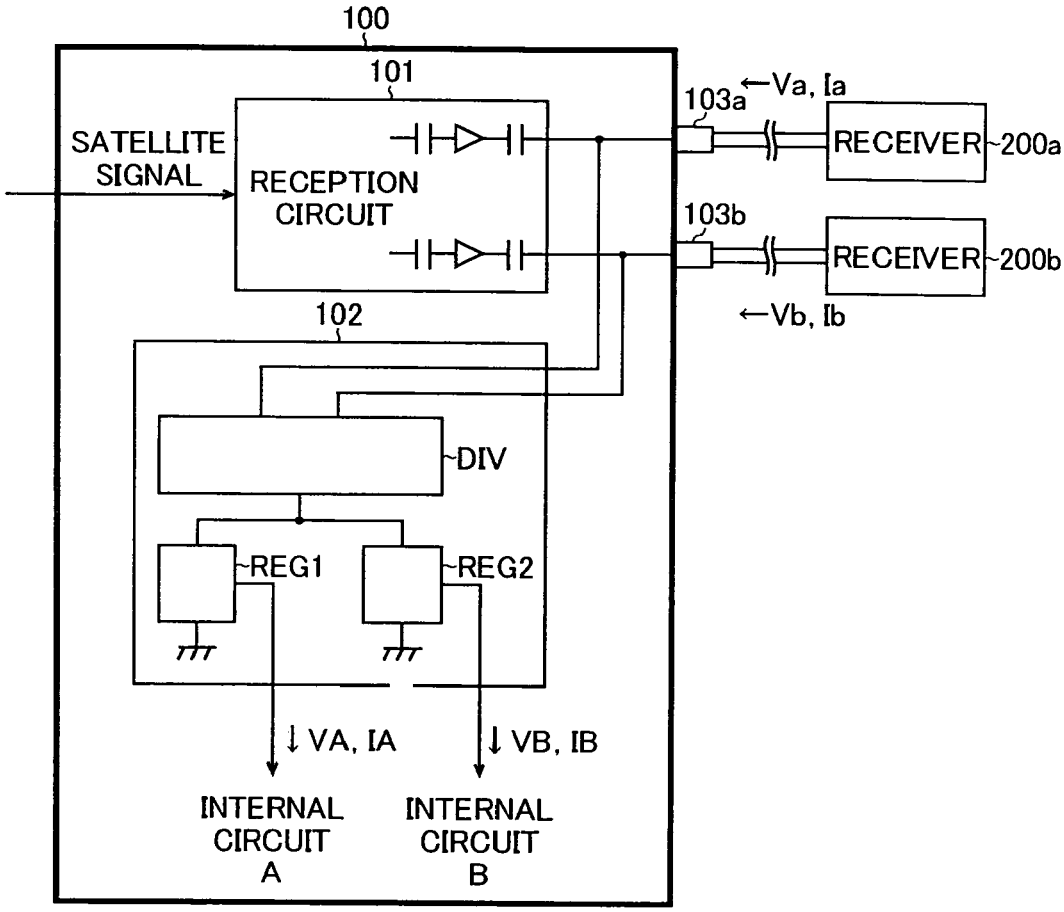
FIG. 4 Prior art
FIG. 4 is a block diagram showing another example of a conventional LNB.

A practical example of such a configuration is shown, as a second embodiment of the invention, in FIG. 2. Here, a first diode array composed of bypass diodes D11 and D12 connected in series and a second diode array composed of bypass diodes D21 and D22 connected in series are connected in parallel but in mutually opposite directions between the output terminals of the pre-regulators PR1 and PR2.

With this configuration, as compared with that of the first embodiment described above, it is possible to raise the threshold value that determines whether or not to short-circuit the output terminals of the pre-regulators PRa and PRb. Thus, even if there are slight variations in the output voltages Va' and Vb' of the pre-regulators PRa and PRb, it is possible to prevent malfunctioning of the bypass portion BP.

Specifically, in the first embodiment, where one bypass diode is provided for each bypass path, when the voltage across the bypass diode exceeds the forward voltage thereof (approximately 0.7 [V]), the bypass path comes into a short-circuiting state. By contrast, in the second embodiment, where two bypass diodes are provided for each bypass path, the bypass path does not come into a short-circuiting state unless the voltage across the bypass array exceeds the total forward voltage of the two bypass diodes (approximately 1.4 [V]). Here, for example, consider a case where there is a difference of 1 [V] between the output voltages Va' and Vb' of the pre-regulators RPa and RPb. In this case, in the first embodiment, the bypass portion BP malfunctions and comes into a short-circuiting state. By contrast, in the second embodiment, such malfunctioning does not occur, and therefore more stable current control is possible.

The second embodiment described above deals with a case where two bypass diodes are provided for each bypass path. It should be understood, however, that the present invention may be implemented with any other configuration. For example, as necessary, three or more bypass diodes may be provided so long as the main regulators REG1 and REG2 can generate, from the output voltages Va' and Vb' of the pre-regulators PRa and PRb, the output voltages VA and VB even when the total voltage drop across the bypass portion BP is allowed for.

The first and second embodiments described above deal with cases where two receivers are connected to the LNB 10, and the internal circuits of the LNB 10 are grouped into two sections. It should be understood, however, that the present invention may be implemented with any other configuration; that is, any number of receivers may be connected, and the internal circuits may be grouped into any number of sections.

Obviously, many modifications and variations of the present invention are possible in light of the above teachings. It is therefore to be understood that within the scope of the appended claims, the invention may be practiced other than as specifically described.

The embodiments described above deal with cases where the present invention is applied to an LNB used to build a satellite broadcast reception system. It is to be understood, however, that the application of the present invention is not limited to such cases; that is, the present invention finds wide application in receiver apparatuses in general to which a plurality of receivers are connected.

The present invention is suitable for an LNB or the like used to build a satellite broadcast reception system, and is a very useful as a means for preventing malfunctioning of the apparatus and disturbances in received images.

What is claimed is:

1. A receiver apparatus comprising:

a plurality of external terminals to which receivers are individually disconnectably connected;

a plurality of internal circuits having mutually different power source paths; and a power supply circuit that receives electric power from the receivers and generates drive voltages for the internal circuits, wherein the power supply circuit includes:

pre-regulators provided one for each of power supply paths respectively from the external terminals;

a bypass portion that, when a potential difference between output terminals of the pre-regulators is greater than a predetermined threshold value, short-circuits together the output terminals; and main regulators provided in a stage following the bypass portion so as to generate, from output voltages of the pre-regulators, the drive voltages for the internal circuits.

2. The receiver apparatus according to claim 1, wherein the bypass portion is composed of a pair of diodes or a pair of diode arrays connected in parallel but in mutually opposite directions between the output terminals of the pre-regulators.

3. The receiver apparatus according to claim 1, wherein the plurality of internal circuits are different sections of the receiver apparatus into which various circuit elements constituting the receiver apparatus are grouped according to power consumption thereof and relationship thereof with the receivers.

4. The receiver apparatus according to claim 1, further comprising:

a reception circuit that extracts a plurality of channel signals from a received signal, and that then selects the channel signals requested by the receivers to feed the selected signals thereto, wherein direct-current voltages fed from the receivers are used not only as input voltages to the power supply circuit but also as output select signals for the reception circuit, each of the output select signals being shifted among a plurality of voltage levels according to a frequency band of a desired channel signal.

5. The receiver apparatus according to claim 1, wherein outputs of the pre-regulators are equal.

6. A satellite broadcast reception system comprising:

a reflector;

a receiver apparatus connected to the reflector; and receivers connected to the receiver apparatus, wherein the receiver apparatus includes:

a plurality of external terminals to which the receivers are individually disconnectably connected;

a plurality of internal circuits having mutually different power source paths; and a power supply circuit that receives electric power from the receivers and generates drive voltages for the internal circuits, wherein the power supply circuit includes:

pre-regulators provided one for each of power supply paths respectively from the external terminals;

a bypass portion that, when a potential difference between output terminals of the pre-regulators is greater than a predetermined threshold value, short-circuits together the output terminals; and main regulators provided in a stage following the bypass portion so as to generate, from output voltages of the pre-regulators, the drive voltages for the internal circuits.

7. The satellite broadcast reception system according to claim 6, wherein the bypass portion is composed of a pair of diodes or a pair of diode arrays connected in parallel but in mutually opposite directions between the output terminals of the pre-regulators.

8. The satellite broadcast reception system according to claim 6, wherein the plurality of internal circuits are different sections of the receiver apparatus into which various circuit elements constituting the receiver apparatus are grouped according to power consumption thereof and relationship thereof with the receivers.

9. The satellite broadcast reception system according to claim 6, wherein the receiver apparatus further includes:

a reception circuit that extracts a plurality of channel signals from a satellite signal received via the reflector, that then amplifies the extracted signals on a low-noise basis, and that then selects the channel signals requested by the receivers to feed the selected signals thereto, and wherein direct-current voltages fed from the receivers are used not only as input voltages to the power supply circuit but also as output select signals for the reception circuit, each of the output select signals being shifted among a plurality of voltage levels according to a frequency band of a desired channel signal.

10. A receiver apparatus comprising:

a plurality of external terminals to which receivers are individually and removably connected;

a plurality of internal circuits having mutually different power source paths; and a power supply circuit that receives electric power from the receivers and generates drive voltages for the internal circuits, wherein the power supply circuit includes:

receiving units provided one for each of power supply paths respectively from the external terminals;

a bypass portion that, when a potential difference between output terminals of the receiving units is greater than a predetermined threshold value, short-circuits together the output terminals; and main regulators provided in a stage following the bypass portion so as to generate, from output voltages of the pre-regulators, the drive voltages for the internal circuits, wherein the bypass portion is composed of a pair of diodes or a pair of diode arrays connected in parallel but in mutually opposite directions between the output terminals of the receiving units.

11. The receiver apparatus according to claim 10, further comprising:

a reception circuit that extracts a plurality of channel signals from a received signal, and that then selects the channel signals requested by the receivers to feed the selected signals thereto, wherein direct-current voltages fed from the receivers are used not only as input voltages to the power supply circuit but also as output select signals for the reception circuit, each of the output select signals being shifted among a plurality of voltage levels according to a frequency band of a desired channel signal.

* * * * *